United States Patent [19]

Ballarati et al.

[11] Patent Number: 4,537,227

[45] Date of Patent: Aug. 27, 1985

[54] FABRICS WITH A CREPE EFFECT CONSTITUTED BY CONTINUOUS TEXTURIZED SYNTHETIC YARNS OF HIGH YARN/COUNT/NO. OF FILAMENTS RATIO

[75] Inventors: Vito Ballarati, Cuggiono; Franco Tajana, Como, both of Italy

[73] Assignee: Val Lesina S.p.A., Como, Italy

[21] Appl. No.: 369,667

[22] Filed: Apr. 19, 1982

[30] Foreign Application Priority Data

Apr. 24, 1981 [IT] Italy ..... 21372 A/81

[51] Int. Cl.[3] ..... D03D 15/08; D04B 1/14; D06C 23/04

[52] U.S. Cl. ..... 139/420 R; 139/421; 139/426 R; 28/155; 57/247; 66/202

[58] Field of Search ..... 139/426 R, 420 R, 420 A; 28/155, 156; 57/247, 287, 246; 66/202

[56] References Cited

U.S. PATENT DOCUMENTS

| | | | |
|---|---|---|---|
| 3,279,164 | 10/1966 | Breen et al. | 57/287 |
| 3,373,774 | 3/1968 | Cruz | 139/426 R |
| 3,938,227 | 2/1976 | Kawasaki et al. | 28/155 |
| 3,995,420 | 12/1976 | Ohse et al. | 57/247 |
| 4,098,097 | 7/1978 | Langanke et al. | 66/202 |
| 4,145,870 | 3/1979 | Klee et al. | 57/247 X |
| 4,164,838 | 8/1979 | Bach et al. | 57/247 |

FOREIGN PATENT DOCUMENTS

| | | | |
|---|---|---|---|
| 754170 | 12/1970 | Belgium | 139/420 R |
| 1203694 | 8/1959 | France . | |
| 2051335 | 4/1971 | France . | |
| 2124935 | 9/1972 | France . | |
| 2135092 | 12/1972 | France . | |
| 46-42064 | 12/1971 | Japan | 28/155 |
| 50-18113 | 6/1975 | Japan | 28/155 |
| 51-84971 | 7/1976 | Japan | 139/426 R |
| 53-139863 | 12/1978 | Japan | 57/247 |
| 55-8613 | 3/1980 | Japan | 57/247 |
| 1224692 | 3/1971 | United Kingdom | 66/202 |

*Primary Examiner*—James Kee Chi

*Attorney, Agent, or Firm*—Stevens, Davis, Miller & Mosher

[57] ABSTRACT

Chain-weft fabrics and knitted fabrics, with a crepe effect, are obtained from continuous texturized synthetic yarns, substantially non-twisted, having a high "yarn count/no. of filaments" ratio, and a high shrinkage under hot conditions, and particularly yarns of 30–160 Dtex comprising filaments of between 5 and 19 Dtex.

5 Claims, No Drawings

FABRICS WITH A CREPE EFFECT CONSTITUTED BY CONTINUOUS TEXTURIZED SYNTHETIC YARNS OF HIGH YARN/COUNT/NO. OF FILAMENTS RATIO

This invention relates to fabrics with a crepe effect produced from continuous texturized synthetic yarns, characterised in that the yarns are parallel, i.e. preferably non-twisted, have a high "yarn count/no. of filaments" ratio and preferably have high shrinkage in boiling water. The invention also relates to the relative method. The main characteristic of crepe fabrics of the known art, which distinguishes them from other fabrics, is the more or less accentuated particular crinkling of its surface.

This crinkling, due to a slight regular crimp in the yarns or to a special geometrical arrangement thereof related to the type of weave, gives the fabric special characteristics which can be summarised as follows: a non-smooth surface, crinkled but not rough; not bright but rather opaque and at the same time shiny because of its particular way of reflecting light, caused by the orientation of the yarns; and a feel which is not flabby or inert, but is sustained and lively, although not rigid. At the present time, woven and knitted fabrics with a crepe appearance are normally produced by using twisted yarns having a number of twists per meter which often exceeds 1000.

Another system, which enables apparently similar effects to be obtained without having to use twisted yarns utilizes special weaves by means of which, with a particular arrangement of the yarns, a crinkled sensation is obtained which to some extent resembles the typical sensation of fabrics produced with twisted yarns.

It is a fact that the best results are obtained only by using twisted yarns, the use of which also gives total freedom in the choice of weaves.

In the field of synthetic polymer yarns, the conventional process for producing yarns for crepe fabrics involves several successive operations.

These include spinning the molten polymer into filaments, cooling and partly drawing the filaments, grouping the filaments to form a yarn and collecting this on spools.

In order to obtain the required physical and mechanical characteristics, the partly drawn yarn has to be subjected to a subsequent final drawing operation with suitable drawing machines.

The yarn drawn in this manner is twisted on twisting machines at a yarn feed speed which is strictly related to the ratio of the rotational speed of the spindle to the required number of twists per meter.

With normal spindle twisting machines, speeds of 10,000 to 12,000 r.p.m. can be attained. Thus, for a yarn requiring a twist of 800 revolutions, the feed speed cannot exceed 12–15 m per minute. For a twist of 1,500 revolutions, this latter falls to 6–8 m/minute.

With twisting machines using double twist spindles, approximately double speeds are attained, but there are certain limitations with regard to the type of feed yarn pack.

The twisted yarn packs obtained are set in an autoclave at a temperature kept between 60° and 100° C. for a time variable from 30 to 60 minutes, in order to stabilize the twist and allow subsequent regular unwinding of the yarn.

This type of process has many drawbacks, in particular the very low hourly production rate, which makes it necessary to use a large number of spindles with consequent considerable energy consumption, large surface areas necessary for locating the machines, and high labor costs. In addition, great care has to be taken during the processing in order not to mix yarns having opposite twists or yarns which have not undergone the various processing stages under identical conditions.

In order to improve its characteristics, the twisted yarn obtained in this manner is normally texturized on false twist machines.

This invention teaches a method for producing fabrics with a crepe effect, which undoubtedly appears highly novel. In this respect it is now possible, with the invention, to dispense with the use of twisting machines which up to now have had to be used in order to produce crepe fabrics, and instead to use only texturizing machines. In addition, by using a partly oriented yarn, with the invention it is possible to also dispense with the use of drawing machines, this being a stage normally necessary before passing the yarn through the twisting machines, as drawing is carried out simultaneously with the texturizing. In this manner, the production rate of the yarn, drastically limited to 10–20 m/min., increases to the 600–700 m/min. of modern texturizing machines.

This results in smaller plants, a reduced labor requirement and considerably lower overall costs.

In this respect, according to the invention it has been found that fabrics with a crepe effect can be obtained by texturizing a continuous synthetic yarn with parallel filaments having a final count per filament between 5 and 19 Dtex, and preferably between 7 and 11 Dtex. The synthetic yarn may be polyester, polyamides or modifications thereof. According to the invention it has been further found that for equal texturized yarn counts, if the number of filaments is reduced, with a consequent increase in the "yarn count/no. of filaments" ratio and consequently in the count of the individual filament, a greater stretch resistance is obtained together with a more rapid recovery of the initial dimensions, the initial toughness is maintained after the texturizing process, and there is a greater shrinkage in boiling water.

The yarn also has a marked crimp development, a moderate bulkiness and a strong crinkled feeling. This method is particularly suitable for yarns having a count of between 30 and 160 Dtex.

The invention therefore comprises a method for producing fabric with a crepe effect, in which yarns having a high "count/no. of filaments" ratio are texturized and then passed through the setting oven at a temperature such as to preferably obtain a high shrinkage in boiling water in excess of 28%.

Texturizing is carried out by means of known false twist machines, either of the magnetic spindle type or of the friction type, with a temperature being maintained in the setting oven such as to obtain a yarn preferably with high shrinkage, then using this type of texturized parallel yarn, i.e. preferably non-twisted, for weaving instead of the yarn having a large number of twists which is usually used for producing crepe fabrics. The fabrics produced according to the invention from this type of yarn by using normal weaves (such as cloth, twill or satin in the case of chain-weft looms or interlock or single jersey in the case of circular knitting machines) surprisingly have a highly crinkled feel, whereas with normal non-twisted yarns the feel is completely smooth.

The invention is further illustrated in a non-limiting manner by the following examples.

EXAMPLE 1

A weaving test is carried out on a Nissan LV/51 straight water loom using for the weft a parallel polyester yarn texturized on a false twist machine with a magnetic spindle, and having the following characteristics:

Count: 57.7 Dtex
Number of filaments: 6
Filament cross-section: triangular
Filament count: 9.58 Dtex
Ultimate tensile stress: 204 gr.
Ultimate elongation: 29.3%
Shrinkage in boiling water: 30.5%
Crimp: 25.9

This yarn is woven at a rate of 420 insertions per minute with a cloth weave on a chain having a height of 1690 mm formed by 6400 parallel texturized polyester yarns having a count of 56 Dtex and 48 filaments, with a reeding of 19/2 and a density of 30 wefts/cm.

A raw fabric is obtained having a width of 160 cm, which is then scoured, dyed and finished by the following procedure: it is loaded on to a jet type cord dyeing apparatus (Mezzera) and treated for 30 minutes in a scouring bath constituted by water softened by ion exchange resin treatment and kept at 90° C., and containing 10 cc/liter of 36/38 Be caustic soda, 5 cc/liter of a detergent and 0.5 g/liter of a sequestering agent. Two wash cycles with hot and cold water then take place, followed by neutralization with acetic acid.

Dyeing is carried out on the same apparatus using a disperse dye of type Disperse Blue Color Index 056, dissolved in a softened water bath to give a dye concentration of 2% of the weight of the fabric, and with the addition of 2% of an equalising agent and 0.2% of a dispersing agent. The pH is adjusted to 4.5 by adding formic acid and stabilized with monosodium phosphate. Dyeing is carried out using the following temperature cycle: starting from 60° C., the temperature rises to 130° C. at a rate of 1° C./minute, and 130° C. is maintained for 20 minutes; the temperature then falls to 80° C. at a rate of 1° C./minute; the dye bath is then discharged and the fabric washed with hot and cold water. The fabric, centrifuged and dried in hot air, is passed through a stenter and heat-set at 165° C. at a speed of 25 m/minute.

A fabric is obtained having a width of 138 cm, a weight of 54 g/m$^2$ and a weft shrinkage, from raw to finished, of 14%. A test carried out with the Hoffman press using steam at 4 atmospheres, with the fabric being left free for 20 seconds and then pressed for a further 20 seconds, indicates a dimensional stability better than 2%. The fabric has an appearance and feel similar to "crepe chine", this effect being normally obtained by weaving yarns of equal count but having more than 1000 revolutions of twist.

EXAMPLE 2

A weaving test is carried out on a Nissan LV/51 water loom using as weft a parallel polyester yarn texturized on a false twist machine with friction spindles, and having the following characteristics:

Count: 56.4 Dtex
Number of filaments: 6
Filament cross-section: triangular
Filament count: 9.40 Dtex
Ultimate tensile stress: 191 g
Ultimate elongation: 31.1%
Shrinkage in boiling water: 31.3%
Crimp: 26.4.

This yarn is woven at a rate of 390 insertions per minute with a cloth weave on a chain of height 1860 mm formed by 5600 parallel texturized polyester yarns having a count of 56 Dtex and 48 filaments, with a reeding of 15/2 and a density of 30 wefts/cm.

A raw fabric of width 181 cm is obtained, which is then scoured, dyed and finished in accordance with the procedure of example 1.

In this manner, a fabric is obtained having a width of 159 cm, a weight of 50 g/m$^2$ and a weft shrinkage, from raw to finished, of 12%.

A test using the Hoffman press with steam at 4 atmospheres indicates a dimensional stability better than 2%. Again in this case, the fabric has an appearance and feel similar to the "crepe chine" normally used for making headscarves.

EXAMPLE 3

A weaving test is carried out on a SAMO double face circular interlock knitting machine, having the following characteristics:

Cylinder diameter: 30 inches
Number of feeds: 48
Needle fineness: 32
Number of 3 cm columns: 44
Number of 3 cm rows: 58
Effective speed: 24 r.p.m.

The texturized polyester yarn of example 1 having a count of 57.5 Dtex and 6 filaments is used, and is fed at a tension of 2 grams.

A raw tubular fabric is obtained having a weight of 80 g/m$^2$, which is then dyed in the form of a cord on a jet type machine, using the same dyeing procedure as in example 1, and adding 0.5 g/liter of sodium chlorate and 0.1 g/liter of a sequestering agent to the bath.

After drying, the dyed tubular fabric is opened and then passed through a stenter and heat-set at 170° C. at a speed of 20 m/min.

A finished fabric is obtained having a width of 140 cm and a weight of 95 g/m$^2$. A test carried out on the Hoffman press indicates a dimensional stability better than 2.5%.

The appearance of the knitted fabric and its feel are completely different from those obtained with a normal texturized yarn of equal count and with a greater number of filaments (e.g. 16, 24, 36 etc.).

In this respect, the fabric is more resilient, much less smooth and shiny, decidedly crinkled and slightly rough to the touch. Its appearance is comparable to a fabric obtained using a yarn of equal count and with about 1200 twist revolutions, but it is perhaps less pleasant to the touch because of the more accentuated roughness.

We claim:

1. A fabric with a crepe effect comprising continuous synthetic yarns which are texturized, substantially non-twisted, have a count between 30 and 160 Dtex, a yarn count/no. of filaments ratio between 7 and 11 Dtex, and a shrinkage in boiling water higher than 28%.

2. A fabric as claimed in claim 1, wherein the weight of said yarns exceeds 20% of the weight of the fabric.

3. A fabric as claimed in claim 11, wherein the yarn synthetic material is selected from the group consisting of polyester, polyamides and modifications of polyester and polyamides.

4. A fabric as claimed in claim 2, wherein the yarn synthetic material is selected from the group consisting of polyester, polyamides and modifications of polyester and polyamides.

5. A method for producing fabric with a crepe effect, comprising a step in which substantially non-twisted yarns having a count between 30 and 160 Dtex and a yarn count/no. of filaments ratio between 7 and 11 Dtex are texturized, then are passed through a setting oven at such a temperature as to obtain shrinkage in boiling water of at least 28%, and are used to produce a fabric having a crepe effect.

* * * * *